United States Patent [19]

Dixon

[11] Patent Number: 4,486,022

[45] Date of Patent: Dec. 4, 1984

[54] SPORTS BOARD GAMES

[76] Inventor: Arthur R. Dixon, 3463 Tully Rd., San Jose, Calif. 98148

[21] Appl. No.: 467,733

[22] Filed: Feb. 18, 1983

[51] Int. Cl.[3] ..... A63F 3/00

[52] U.S. Cl. ..... 273/256; 273/244

[58] Field of Search ..... 273/256, 244, 247, 259

[56] References Cited

U.S. PATENT DOCUMENTS

| | | | |
|---|---|---|---|
| 2,026,082 | 12/1935 | Darrow | 273/256 |
| 2,976,044 | 3/1961 | Corpering | 273/256 |
| 4,010,957 | 3/1977 | Tricoli | 273/256 |
| 4,027,882 | 6/1977 | Rosenberg | 273/256 X |

FOREIGN PATENT DOCUMENTS

| | | | |
|---|---|---|---|
| 1131667 | 9/1982 | Canada | 273/256 |
| 627951 | 8/1949 | United Kingdom | 273/247 |
| 1479092 | 7/1977 | United Kingdom | 273/247 |
| 2051590 | 1/1979 | United Kingdom | 273/256 |

*Primary Examiner*—Richard C. Pinkham
*Assistant Examiner*—Scott L. Brown
*Attorney, Agent, or Firm*—William Green & Associates

[57] ABSTRACT

A series of board games wherein players attempt to maximize their financial worth by buying, selling and trading performers, each including a game board representing a specific sport and having a plurality of spaces located about the board forming a path for movement of game pieces. Designated spaces on each board represent professional athletes or performers of the respective sport and activities relating to that sport. Each player is provided with a token which the player moves around the board as directed by chance means such as dice. Each performer space represents a specific performer and has two designated values marked thereon, an acquisition value and an income value. Other spaces direct players to take actions, relevant to the sport which will retard, promote or in some instances not affect the players' chances of winning the game. Sets of cards corresponding to the performers, teams, stadiums and game related actions are provided. The team cards have a number of performers on them and the stadium cards contain a second income value for corresponding performer income spaces.

11 Claims, 19 Drawing Figures

STADIUM TITLE
COST $ 1,000,000

| PLAYER COST | INCOME |
|---|---|
| $ 400,000 | $ 50,000 |
| $ 1,000,000 | $ 100,000 |
| $ 1,500,000 | $ 200,000 |
| $ 2,000,000 | $ 300,000 |

TAXES- $ 100,000

36

STADIUM TITLE
COST $ 2,000,000

| PLAYER COST | INCOME |
|---|---|
| $ 400,000 | $ 100,000 |
| $ 1,000,000 | $ 150,000 |
| $ 1,500,000 | $ 250,000 |
| $ 2,000,000 | $ 350,000 |

TAXES- $ 200,000

STRIKE INSURANCE $ 1,000,000

*RENEWAL $500,000*

*"PLAYERS MAY BE STRIKING SOON"*

INCOME
$ 100,000
COST
$ 2,000,000

PLAYER STATISTICS

SPORTS BOARD GAMES

BACKGROUND OF THE INVENTION

1. Field of the Invention

This invention relates to board games in general and more particularly relates to board games designed to simulate the buying, selling and trading of professional sports performers whose values are affected by acquisition and improvement of stadiums and by action cards.

2. Description of the Primary Art

Numerous board games exist that have the objective of acquiring property, amassing capital or points, or similar objects, U.S. Pat. Nos. 2,026,082; 3,826,498; 4,010,957 and 3,997,166 are examples. However none of the prior art or games deal with the personal appeal of the individual performers to the general public or the business aspects of professional performers and their relationships with owners, which often overshadow their on-field performances.

SUMMARY OF THE INVENTION

The primary object of this invention is to provide a series of Sports Game Boards which pertain to the relationships among professional sports organizations, their owners, their performers and a Commissioner for that sport and in which the players of the game compete as owners to acquire money through buying and trading performers, ownership and improvement of stadiums and the chance movement of game pieces.

Another object of this invention is to provide novel game boards which are related to sports, but emphasize the business aspects of sports rather than the participant aspects.

A further object of this invention is to provide novel game boards which educate the players about the economic factors relating to a given sport.

DESCRIPTION OF THE PREFERRED EMBODIMENT

Figure 1:
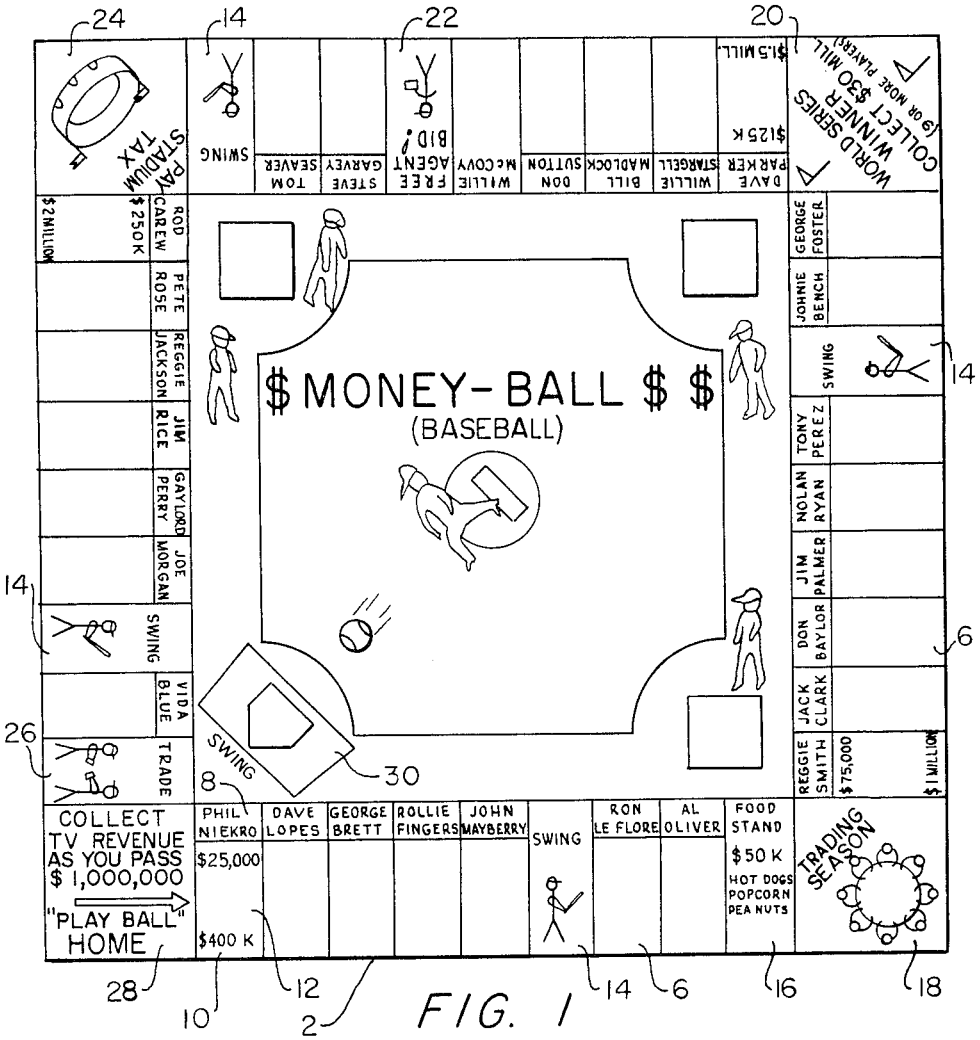
FIG. 1. is a top plan view of a board relating to the game of baseball.

A typical game board 2 for the game of baseball according to the present invention is shown in FIG. 1. Board 2 has forty contiguous spaces positioned along its periphery. The spaces include twenty-nine performer spaces some of which are generally designated at 6, each of which has a name area 8 inscribed within which is the name of a baseball player, and a value area 10 within which are two dollar amounts, one of which represents the income which that baseball player generates when a token of a game participant who does not own that performer lands on that space and a larger amount which represents the cost of acquiring that baseball player. For example the Phil Niekro performer space 12 has within name area 8 the name Phil Niekro, and within value area 10 the amounts $25,000.00 and $400,000.00, which respectively represent the income which that performer generates and the costs of acquiring him. In the embodiment shown in FIG. 1. the remaining spaces 4 include four swing spaces 14, a food stand space 16, a trading season space 18, a World Series winner space 20, a free agent bid space 22, a pay stadium tax space 24, a trade space 26, and a home space 28. The interior of game board 2 also contains a swing card stock pile area 30.

Figure 2:
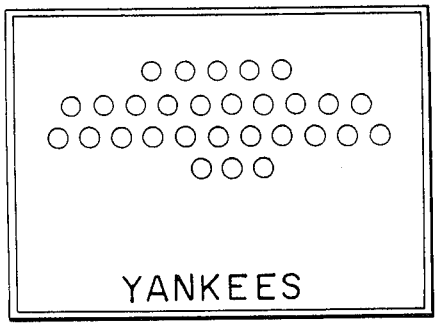
FIG. 2. is the front of a typical Team Card for the baseball game shown in FIG. 1.
Figure 3:
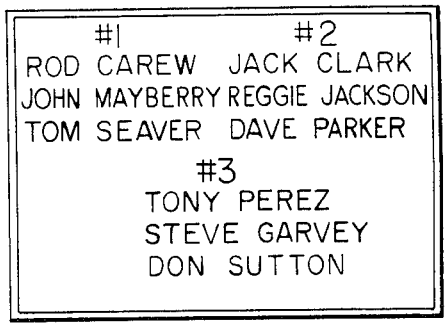
FIG. 3. is the back of a typical Team Card for the baseball game shown in FIG. 1.

Referring to FIGS. 2 and 3, a typical team card for the baseball version of the present invention is shown. Each team card represents a major league baseball team. The front of the card represents an entire team and the back of the card has three lists of baseball players, not necessarily from the same team. In this embodiment of the game there are three baseball players on each list. The baseball players whose names appear on the back of the team cards also appear on performer spaces 6 of game board 2.

Figures 4, 5, 6, 7, 8, 9:
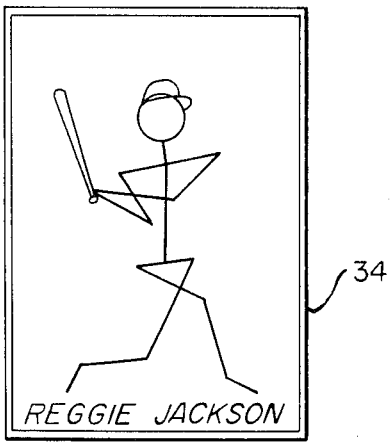
FIG. 4. is the front of a typical Performer Card for the baseball game shown in FIG. 1.
FIG. 5. is the back of a typical Performer Card for the baseball game shown in FIG. 1.
FIGS. 6 and 7. show typical Stadium Cards for the baseball game shown in FIG. 1.
FIG. 8 is a typical Insurance Card for the baseball game shown in FIG. 1.
FIGS. 9–13. show typical Action Cards for the baseball game shown in FIG. 1.
Figure 10:
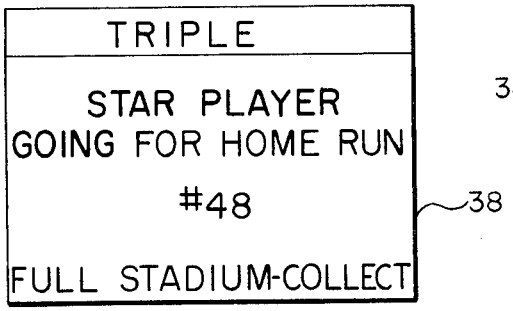
Figure 11:
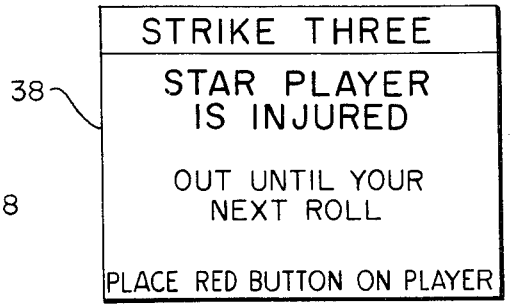
Figure 12:
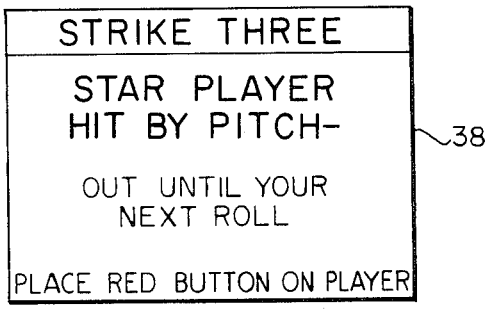
Figure 13:
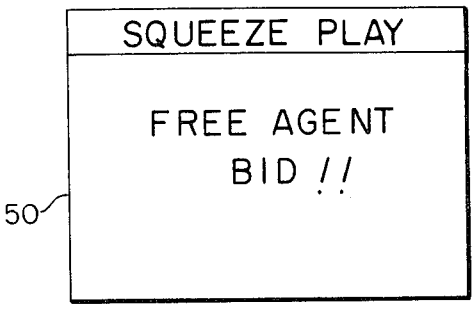
Figure 14:
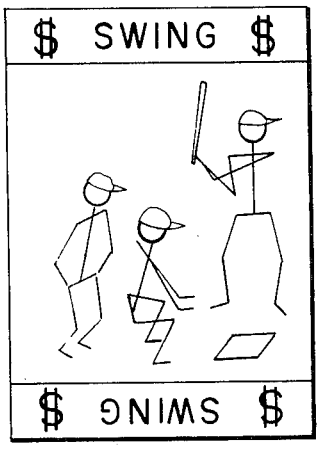
FIG. 14. shows the back of the Action Cards for the baseball game shown in FIG. 1.
Figure 15:
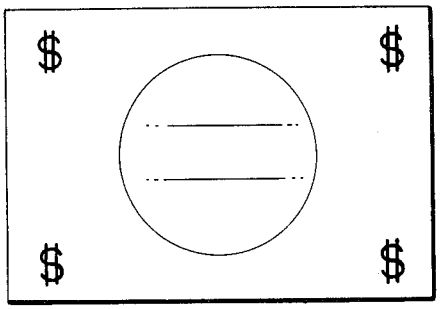
FIG. 15–19. respectively show Play Money, Token, Stadium, Dice and Penalty Marker for use in the baseball game shown in FIG. 1.
Figure 18:
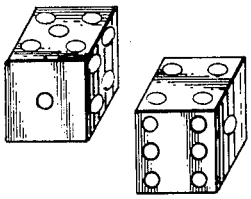
Figure 16:
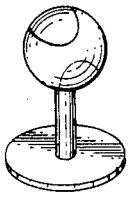
Figure 19:
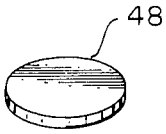
Figure 17:
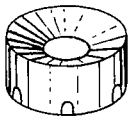

Referring to FIGS. 4 and 5 a typical performer card for the baseball version of the present invention is shown. The performer cards 34 correspond to performer spaces 6 and contain a picture of a performer on the front card the same information as performer spaces 6 on the back.

FIGS. 4, 5, 6 and 7 show typical stadium cards 36. Each stadium card includes the following information: stadium cost, player income, player cost, and taxes. There are four different versions of stadium cards and 16 total stadium cards.

FIG. 8 shows a Strike Insurance Card which may be purchased from the Commissioner to protect a player from strikes.

FIG. 9 shows the back on the "players on strike card".

FIGS. 10–14 show a plurality of swing cards 38 each containing actions related to the game of baseball which affect the outcome of the game, either directly or indirectly, such as bonuses, the right to trade or sell performers, strikes, the right to collect TV revenues, stadium taxes etc.

As shown in FIGS. 15–19 the present embodiment of the invention also provides for play money player tokens 48, stadium replica, dice, and penalty markers 48.

The play of the game proceeds as follows:

Game Board 2 is placed on a flat surface and the set of swing cards 38 is placed on the board at the swing card stack pile area 30 marked swing. A Commissioner is chosen by the participants, the Commissioner can be one of the participants or a non-participant. The Commissioner is in charge of the bank, collects and passes out play money, performer cards, stadium cards, team cards, strike insurance cards and presides over the Trading Sessions, Trades, and Free Agent bidding. Any dispute that arises during the game is arbitrated by the Commissioner. If the Commissioner plays in the game, disputes not covered by rules will be settled by mutual agreements of the participants. The Commissioner keeps personal money separate from that of the bank.

To begin play the Commissioner gives each participant $10,000,000.00.

The particupants then roll the dice and the participant with the highest total starts the game by selecting a token,, then the participant with the next highest total selects a token, and the process continues until all participants have selected a token.

Next the participants begin bidding for a team. Bidding starts at $2,500,000.00 and the highest bidder gets the right to purchase a team by paying the Commissioner the amount bid, whereupon the Commissioner gives the participant the team card. Participants may inspect team cards before bidding. A team card is given to the particpant who purchases that team.

The starting position on game board 2 is the home space 28. The participants place their tokens on the home space 28. The participant who rolled the highest number in the token selection process rolls the dice first; the total of the numbers rolled, hereinafter referred to as "the number", determines the number of spaces for that participant to move the token. According to the space that the token lands on, a participant will be entitled to exercise various options which will be described. If a participant rolls doubles the token is moved the number of positions indicated on the dice, the option of the space where it lands is exercised and the participant rolls again. The participant continues to roll until doubles are no longer rolled. Each time a participant passes home space 28 that participant collects $1,000,000.00 from the Commissioner.

If a participant lands on a space owned by another participant the participant must pay the owning participant the income as indicated on that space. If there is a stadium on that space then the owning participant must be paid the amount indicated on the stadium card. Each participant's token remains on the board until the participant's turn to roll comes up again. Two or more tokens may occupy the same position in the field.

Game board 2 as illustrated in FIG. 1. shows a field of play consisting of forty spaces extending around the outer perimeter of the board. Twenty-nine of the spaces, performer spaces 6, represent professional baseball players. The name of each baseball player appears at the top of the space in name area 8, the cost of acquiring the player appears at the bottom of the space in value area 10, and the income appearing under the baseball player's name at the top of value area 10. In this embodiment of the game all baseball players having the same acquisition cost and the same income are on the same side of the board. Those having acquisition costs of $400,000.00 and incomes of $25,000.00 are located between home space 28 and trading season space 18, those having acquisition costs of $1,000,000.00 and incomes of $75,000.00 are located between trading season space 18 and World Series Winner space 20; those having acquisition costs of $1,500.,000.00 and incomes of $125,000.00 are located between World Series winner space 20 and pay stadium tax space 24 and those having acquisition costs of $2,000,000.00 and incomes of $250,000.00 are located between pay stadium tax space 24 and home space 28.

When World Series winner space 20 is landed on by the mascot of a participant, that participant is entitled to receive $3,000,000.00 from the Commissioner provided that the participant has acquired 9 or more baseball players. When the pay stadium tax space 24 is landed on by a participant, the participant is required to pay to the Commissioner 10% of the value of each stadium owned by that participant, the taxes to be paid on each stadium are indicated on stadium cards 36.

When trading season space 18 is landed on by a participant, all participants may enter into a trading session where participants can trade or sell baseball players.

The strategy of the game is to try to acquire the baseball players listed in the three lists on the team card. Once a participant aquires all of the baseball players on any one list that participant can buy stadiums for those baseball players and thus obtain greater income from any participant who lands there. When a stadium is on a space and an opponent participant lands there, the amount of income that the opponent must pay is shown on the stadium card according to the acquisition cost of the baseball player represented by that space.

When a participant lands on any of the four non-specific action spaces designated as swing spaces 14 the participant must draw a card from the set of swing cards 38 and follow the directions on the cards. In this embodiment of the game swing cards 38 contain incidents related to the game of baseball, some of the incidents will benefit the participant and some will have no effect on the participant's position in the game. If a participant draws any one of the cards that directs the participant to a given space the participant moves forward (unless the card says go back) to that space and exercises the option at the space. If a participant draws a penalty card a penalty marker 48 is placed on any one of a participant's highest priced baseball players. If any of the highest priced baseball players has a stadium located on his performer space 6 then penalty marker 48 should be placed on one of the participant's spaces with a stadium. As long as penalty marker 48 remains on that space opponents do not have to pay the owner of that space.

If certain cards are drawn and the participant owns the number of baseball players indicated on the card then that participant receives from the Commissioner the amount shown on the card. If the participant draws the free agent bid card 50 then that participant must sell any one of his baseball players chosen by an opponent, to that opponent for at least the acquisition cost plus $100,000.00. If more than one opponent wants to buy a baseball player then the owner may make the sale to any one of the opponents. If no participant wishes to buy a baseball player then no action is taken and the next participant plays.

When the "players on strike" card is pulled the participant must place a red penalty button on all players owned and may not collect income from any source until "home" is passed twice (participant may not collect $1,000,000.00 until the 3rd time player passes "home").

When a participant's performers are on strike–

(1) If the participant's token lands on "swing" the participant does not pull a card from the stack.
(2) When other players land on the struck performers space the player receives no income.
(3) All expenses are paid as they come due.
(4) None of the players are subject to "free agency bid" and the owner cannot participate in "trading".
(5) The participant cannot buy performers.
(6) Stadium taxes must be paid when stadium-occupied spaces are landed upon.
(7) "World Series Winner" money cannot be collected.
(8) "Food Stand" money cannot be collected.

Once "home" is passed twice all red penalty buttons are removed and income resumes. The "players on strike" card is kept until "home" is passed twice at which time it is placed at the bottom of the "swing" stack.

When the "players on strike" card comes to the top of the "swing" stack all owners will know it because the back of the "players on strike" card FIG. 9 reads "players may be striking soon!"

When the "players on strike" card is showing, any participant may buy strike insurance for $1,000,000.00. If a participant has strike insurance and pulls the "players on strike" card, the "players on strike" card is placed back in the stack at the bottom and play continues. At this time all owners must renew their strike insurance for $500,000.00 or return their strike insurance cards to the Commissioner.

If a player already has a red penalty button the red button representing a strike supersedes that penalty.

If a participant draws a trade card and if any of the opponents want to trade, then that owner must trade. The owner participant can trade any player unless a stadium has been built on the corresponding performer's space.

The trade can be for any combination of players and money. A player cannot be sold directly. If no offers for a trade are made then the next participant rolls. If forced to trade, the participant must receive equal value or more for any player traded.

If a participant draws a trade or free agent cancellation card, the participant can avoid having to trade or sell if the participant subsequently draws the trade card or free agent bid card 50 or lands on trade space 26 or free agent bid space 22. The participant retains the card until needed. If the participant does not use it at the first opportunity to use it then it must be placed back among the swing cards at the bottom.

If the stadium tax rebate card is drawn, the participant keeps it until needed. When that participant's mascot lands on pay stadium tax space 24, the participant is exempt from paying stadium tax. The participant keeps the card until used, at which time it is placed at the bottom of the swing cards 38.

If a participant draws the all trade or sell card, all the participant's may trade, sell, or exchange baseball players. The participants may make any deals that they choose.

FIGS. 4 and 5 show typical performer cards 34. Each card is represented by a performer space 6 on game board 2. The name of a baseball player appears on the card and on the performer space. The acquisition cost of the baseball player appears on the performer space 6 and on the corresponding performer cards 34, the income for the baseball player also appears on the corresponding space and card. When a participant's token lands on a space representing a performer and the participant decides to acquire the performer, the Commissioner, after being paid the acquisition cost, gives the representative card to the acquiring participant. If an opposing participant lands on a space owned by another participant, the income shown on that space must be paid to the owner by the opponent. If the participant owns a stadium at that location then the amount to be paid is determined by the stadium card. Each performer card 34 has the baseball player's picture on the front of the card.

There are twenty-four team cards as shown in FIGS. 2 and 3 representing each of the twenty-four major league baseball teams. The front of the card pictures the team and the back of each card has three lists of players; in this embodiment of the game there are three baseball players on each list. The baseball players on the list being from the 29 baseball players represented on game board 2.

When a participant acquires all the players on any one of the lists that participant is entitled to place a stadium at the space on the board represented by any one of the baseball players on that list. By placing a stadium on a space, the participant is entitled to receive greater income from an opponent who lands there.

FIGS. 6 and 7 show the stadium cards. In this embodiment of the game there are four categories of stadium cards with a limited number of stadiums in each category. The stadiums are categorized by stadium cost and income.

The income to be paid is dependent upon the cost of the stadium and the acquisition cost of the baseball player where the stadium is placed.

The income for each acquisition cost is listed on the respective stadium cards. The higher the cost of the stadium the greater the income for any given baseball player. A participant is entitled to place a stadium on a performer space when the participant has acquired all the players on any one of the lists on the back of the team card. The baseball player where the stadium is placed must be on the list. If a participant loses any one of the players on a list then that participant cannot build a stadium on the other player spaces on the list. If stadiums are not placed on the player spaces, once a complete list is obtained those players are still subject to trade and free agent transactions.

If there are no more stadiums available from the Commissioner, a participant must wait for someone to sell a stadium back to the Commissioner or buy a stadium from a participant who wants to sell. A selling participant can sell to the Commissioner or any eligible participant at any price. The Commissioner only pays half-price for a stadium when the stadium is repurchased.

If a participant currently has a stadium and wants to acquire a larger stadium for the same position the smaller stadium must first be sold either to another eligible participant or to the Commissioner before buying the larger stadium.

If a participant wants to move a stadium to a different performer space the participant must pay the Commissioner the cost of the stadium being moved. The stadium can only be moved to an eligible player.

In this embodiment of the game each participant is given $10,000,000.00 at the start of the game.

The penalty marker is used to indicate that a participant has drawn one of the cards which penalizes the participant for the period indicated on the card.

Although I have described a specific embodiment of my invention in terms of human athletes, it is apparent that many variations may be made in the configurations and rules of the game including, but not limited to, different sports and to performers such as race horses or race dogs without departing from the scope of the invention as set forth in the claims which follow.

I claim:

1. A sports board game wherein players attempt to maximize their financial worth comprising in combination, (a) a game board having a plurality of contiguous spaces forming a path consisting of, performer spaces having designated thereon the name of a performer and monetary values
non-specific action spaces
specific action spaces (b) a plurality of performer cards, each card corresponding to a performer space on said game board, (c) a plurality of action cards directing actions related to the game, (d) a plurality of team cards representing a designated group of performers and having thereon names of performers designated on said performer spaces, (e) a plurality of stadium replicas, (f) a plurality of stadium cards having data thereon indicating monetary values for performers higher than the monetary values marked on said performer spaces whereby a player who acquires a group of the performers listed on said team cards may place said stadium replicas on performer spaces and be entitled to increased income from opponents, (g) a player token for each player to designate movement along the path of the board, (h) chance means for determining the movement of the player tokens along the path of the board.

2. A sports board game as defined in claim 1 wherein said plurality of spaces form a continuous path.

3. A sports board game as defined in claim 1 wherein said plurality of spaces are contiguous and form a continuous path.

4. A sports board game as defined in claim 1 wherein said performance spaces have
a first value representing an acquisition value for that performer and
a second value representing an income value for that performer.

5. A sports board game as defined in claim 4 wherein said performer cards have monetary values marked thereon corresponding to the monetary values marked on said performer spaces.

6. A sports board game as defined in claim 4 wherein said stadium cards have data thereon indicating income values for performers higher than the income values marked on said performer spaces.

7. A sports board game as defined in claim 1 wherein said performer cards have monetary values marked thereon corresponding to the monetary values marked on said performer spaces.

8. A sports board game as defined in claim 1 wherein a plurality of penalty markers are provided.

9. A sports board game as defined in claim 1 wherein a quantity of play money is provided.

10. A sports game board as defined in claim 1 wherein some of said action cards direct actions which are advantageous to players and others of said action cards direct actions which are disadvantageous to players, said cards to be drawn by players each time their player token rests upon said non-specific action space.

11. A sports game board as defined in claim 1 wherein game board has a designated area for stock-piling said action cards until they are drawn by players.

* * * * *